United States Patent [19]

Leguillochet, deceased et al.

[11] Patent Number: 4,932,323

[45] Date of Patent: Jun. 12, 1990

[54] TYPE HOLDER, PRINTING TYPE AND PRINTING WHEEL INCORPORATING THEM

[75] Inventors: Pierre Leguillochet, deceased, late of Brecey, France, Chantal O. M. N. Debieu, legal representative of Pierre Leguillochet, deceased; Jean Langlet, Caudry, France

[73] Assignee: Sermatec, France

[21] Appl. No.: 303,572

[22] Filed: Jan. 27, 1989

[30] Foreign Application Priority Data

Jan. 29, 1988 [FR] France ..... 88 01043

[51] Int. Cl.[5] ..... B41F 27/02

[52] U.S. Cl. ..... 101/389.1; 400/29; 400/172

[58] Field of Search ..... 101/381, 389.1, 23, 101/377, 382.1; 400/172, 29

[56] References Cited

U.S. PATENT DOCUMENTS

| | | | |
|---|---|---|---|
| 3,086,461 | 4/1963 | Gill | 101/377 |
| 3,157,264 | 11/1964 | Frechette | 197/16 |
| 3,786,386 | 1/1974 | Cardone et al. | 101/389.1 |
| 4,453,468 | 6/1984 | Shenoha | 101/389.1 |

*Primary Examiner*—Edgar S. Burr
*Assistant Examiner*—Joseph R. Keating
*Attorney, Agent, or Firm*—Steele, Gould & Fried

[57] ABSTRACT

Printing type holder, comprising a rotary drive spindle, a support coaxial with the spindle, which is integral in rotation therewith and has at least one cylindrical part with an outer lateral surface, cavities provided on the outer lateral surface, permanent magnets respectively engaged in the cavities, polar members of soft magnetic material which are provided on either side of each permanent magnet, which extend along generatrices of the support and which define between them the cavities in the form of channels extending parallel to the spindle.

5 Claims, 2 Drawing Sheets

TYPE HOLDER, PRINTING TYPE AND PRINTING WHEEL INCORPORATING THEM

Figure 1:
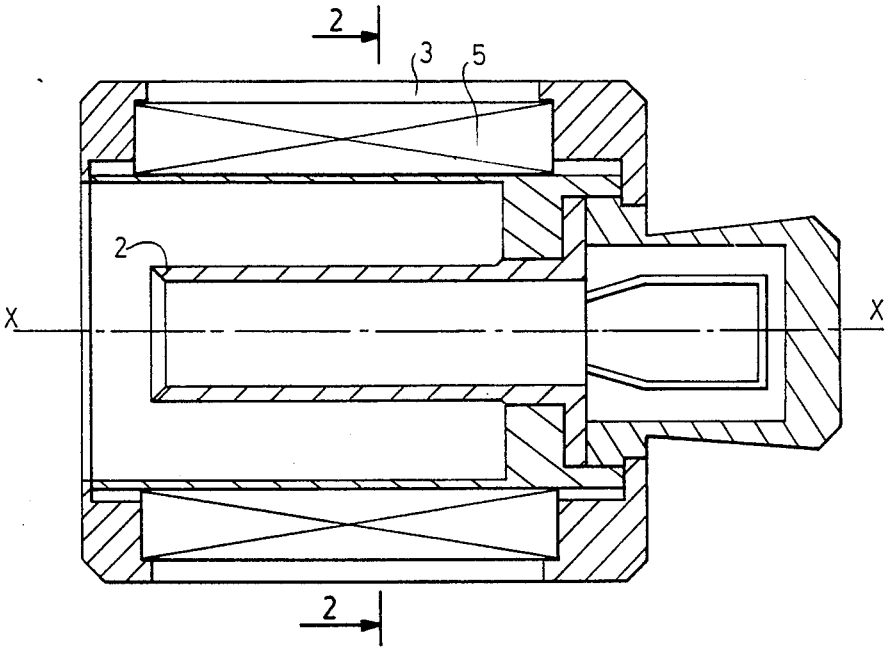

This invention relates to type holders, printing type and printing wheels and more particularly those intended for printing on packaging films in continuous machinery.

A type holder is already known which comprises a cylindrical support and means for holding the type on the support. These means consist of rods which extend into recesses formed on two opposite lateral sides of the base of a character.

In this way it is possible to mount a succession of characters on the type holder to form a line of print, for example parallel to the axis of the support and reading from left to right in this direction. If it is desired to print this same line perpendicularly to the axis of the support and to read it in this direction from left to right, another set of type is necessary because the recesses do not allow the mounting of type at 90°. Otherwise, the line will have to be read from top to bottom, which is not the usual way. On the other hand, if one of the intermediate characters in the line is to be changed, all the preceding characters must first be taken out, if the line extends parallel to the axis of the support.

The invention overcomes these disadvantages with a type holder and associated type which make it possible to position the characters of one set of type at 90° on the type holder and replace any character, wherever it may be, without removing the others.

U.S. Pat. No. 3,086,461 describes a printing type holder comprising a rotary drive spindle and two plates of soft magnetic material mounted on the support, the latter being coaxial with the spindle and integral in rotation therewith. The plates define between them a cylindrical housing on the outer lateral surface of which solid wedge-shaped intermediate parts of the non-magnetic remainder of the support define cavities between them. A common ring magnet appears at the base of each cavity. The characters rest, by their bases, on the sections of the plates forming a polar piece without extending between them. The presence of the polar members increases the retaining force of the characters whilst enabling the characters of a single set to be moved through 90° and for one character to be replaced without the need to remove the others.

However, this type holder has the advantage of using an expensive ring magnet. Whilst being held, the character would tend to move in the direction of rotation of the spindle and for this reason, in addition to the polar members, wedge-shaped intermediate abutments have to be provided, thus complicating the manufacture and assembly of the type holder.

The invention overcomes these disadvantages with a type holder which requires fewer parts and is therefore easier to manufacture and assemble but which nevertheless holds the characters in place more satisfactorily, preventing any movement in the direction of rotation of the spindle, whilst enabling the characters to be replaced easily by others and allowing the characters of a single set to be positioned at 90°.

According to the invention, the polar members extend along the generatrices of the support and define between them cavities in the form of channels extending parallel to the spindle, and a separate permanent magnet engages in each cavity.

As the polar members extend along the generatrices, i.e. perpendicularly to the direction of rotation of the type holder, they not only have a magnetic holding effect but also act as abutments held previously by separate intermediate members which can subsequently be dispensed with. Furthermore, the magnets can now be simple block magnets.

Preferably, each polar member is wedge-shaped, with its apex pointing towards the axis of the support, and has flat lateral surfaces and a flat base. It is, in fact, easier to form the polar members in this way rather than to produce a number of characters in this relatively complicated form.

Preferably, the polar members are integral with the support, thus further increasing the magnetic holding effect and making assembly easier.

The invention also relates to a printing character comprising a body and a base by means of which it engages in a cavity in a type holder, characterised in that the lateral surfaces of the base are flat and the body consists of a mild magnetic material.

Figure 2:
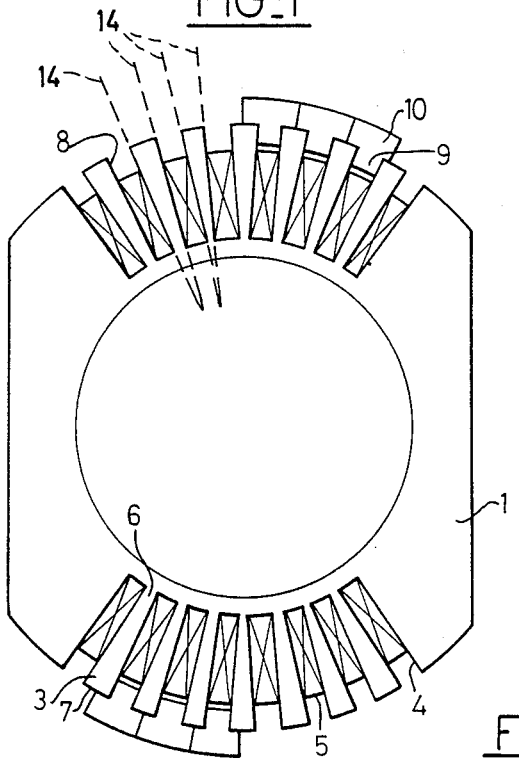
Figure 3:
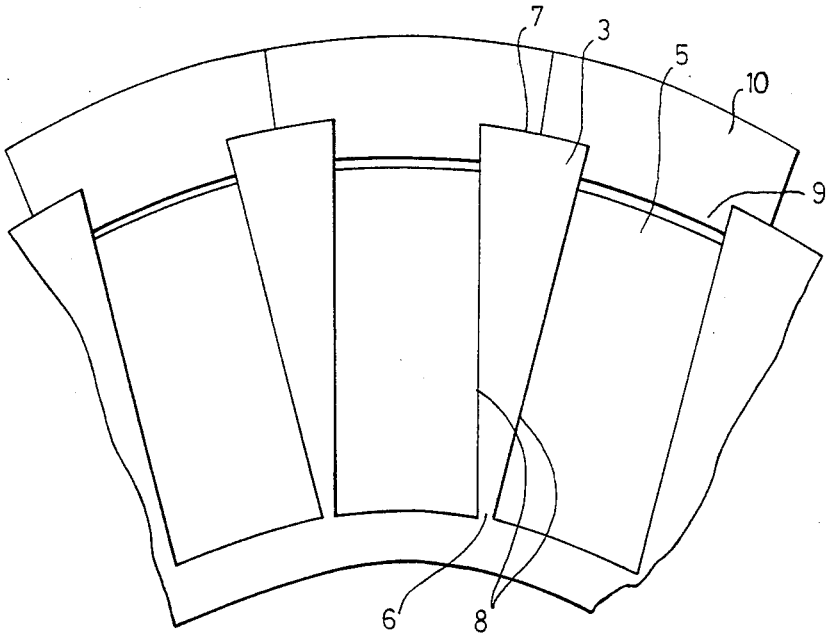
Figure 4:
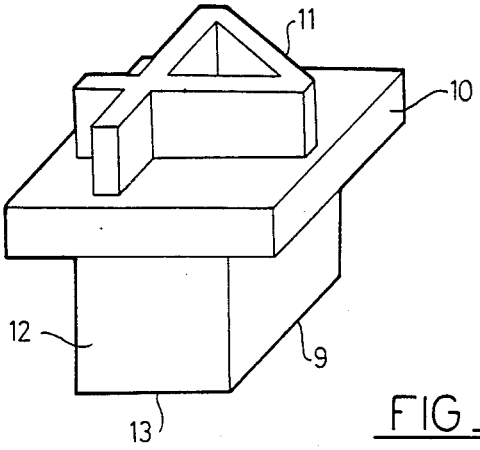

Surprisingly, it has been found that the characters are held sufficiently well, even when transverse forces tending to push the character out of the cavity are applied just before and just after printing. When the base of a character is inserted in a cavity, the magnetic flux channelled by the polar members causes the character to be held more firmly on the support. In the accompanying drawings, which are given solely by way of example:

FIG. 1 is a sectional view of a type holder according to the invention,

FIG. 2 is a sectional view on the line 2—2 of FIG. 1, with the rotary drive spindler omitted, FIG. 3 is a partial view of FIG. 1 on a larger scale and FIG. 4 is a perspective view of a printing character according to the invention. The type holder shown comprises a cylindrical support 1, made of mild steel, force-fitted over a rotary drive spingle 2 having a rotation axis XX. On two diametrically opposite parts of the support 1, polar members 3 issuing therefrom define cavities 4 in which permanent magnets 5 of parallelepiped shape and having a cross section just less than that of the cavities engage over part of the height. Each polar member is wedge-shaped with its apex 6 point towards the axis XX'. It has a flat base 7 and flat lateral surfaces 8. The polar members extend along generatrices 14 of the support and define between them cavities 4 in the form of channels parallel to the axis XX.

Printing characters are each formed of a base 9 a body 100 and an eye 11. The base 9 engages in one of the cavities 1 (FIG. 4).

Side faces 12 and square bottom 13 of the base 9 are flat. The base 9 has a width which is just less than the width of the cavity. The faces 12 which abut the polar members 3 are parallel to the rotation of the body. The body 10 is of mild steel, capable of being magnetised by a permanent magnet.

To mount the character it merely has to be engaged by its base 9 in a cavity 4 until the lower surface of the body 10 comes into contact with two adjacent polar members 3. To remove it, it merely has to be pulled with sufficient force to overcome the force of magnetic attraction.

It is claimed:

1. A printing type holder, comprising:

A rotary drive spindle, a support, which has generatrices, is coaxial with the spindle, is integral in rotation with the spindle and has at least one cylindrical part with an outer laterarl surface, cavities provided on the outer lateral surface, permanent magnets respectively engaged in the cavities, polar members of soft magnetic material, which are provided on either side of each permanent magnet, wherein said polar members are wedge shaped with an apex pointing towards the spindle extend along generatrices of the support and define between them the cavities in the form of channels extending parallel to the spindle.

2. The type holder as claimed in claim 1, wherein each permanent magnet is parallelepiped in shape, having a cross-section just less than that of the cavities.

3. The type holder as claimed in claim 1, wherein the polar members have flat lateral surfaces and a flat base.

4. The type holder as claimed in claim 1, wherein the polar members are integral with the support.

5. A printing wheel which comprises a printing type holder, comprising a rotary drive spindle, a support which has generatrices, is coaxial with the spindle, is integral in rotation with the spindle therewith and has at least one cylindrical part with an outer lateral surface, cavities provided on the outer lateral surface, permanent magnets respectively engaged in the cavities, polar members of soft magnetic material which are provided on either side of each permanent magnet, wherein said polar members are wedge shaped with an apex pointing towards the spindle extend along generatrices of the support and define between them the cavities in the form of channels extending parallel to the spindle and at least one character with a body of mild magnetic material and a base which has lateral flat surfaces, which is smaller in cross section than the body and which is inserted between two polar members.

* * * * *

UNITED STATES PATENT AND TRADEMARK OFFICE

CERTIFICATE OF CORRECTION

PATENT NO. : 4,932,323

DATED : June 12, 1990

INVENTOR(S) : LEGUIILLOCHET Deceased et al

It is certified that error appears in the above-identified patent and that said Letters Patent is hereby corrected as shown below:

In column 2, line 39, that portion of the line which states "spingle" should state --spindle--;

In Claim 1, column 3, line 2, that portion of the claim which states "laterarl" should state --lateral--.

Signed and Sealed this

Eighteenth Day of February, 1992

*Attest:*

HARRY F. MANBECK, JR.

*Attesting Officer*

*Commissioner of Patents and Trademarks*